US007331539B2

(12) United States Patent
Jara-Almonte et al.

(10) Patent No.: US 7,331,539 B2
(45) Date of Patent: Feb. 19, 2008

(54) NOISE REDUCED FOOD WASTE DISPOSER

(75) Inventors: Cynthia C Jara-Almonte, Kenosha, WI (US); Thomas R Berger, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/264,954

(22) Filed: Oct. 4, 2002

(65) Prior Publication Data

US 2003/0066914 A1 Apr. 10, 2003

Related U.S. Application Data

(60) Provisional application No. 60/327,426, filed on Oct. 5, 2001.

(51) Int. Cl.
*B02C 18/42* (2006.01)

(52) U.S. Cl. ..... 241/46.014

(58) Field of Classification Search ..... 241/46.013–46.016; 181/198, 270, 284–294
See application file for complete search history.

(56) References Cited

U.S. PATENT DOCUMENTS

| | | | | |
|---|---|---|---|---|
| 2,965,318 | A * | 12/1960 | Jordan | 241/46.014 |
| 2,975,986 | A * | 3/1961 | Frank | 241/46.014 |
| 3,044,715 | A * | 7/1962 | Woodson et al. | 241/46.014 |
| 3,739,992 | A | 6/1973 | Bebinger | 241/46 |
| 3,801,998 | A * | 4/1974 | Macias | 4/629 |
| 3,814,333 | A * | 6/1974 | Sapienza | 241/46.014 |
| 3,862,720 | A * | 1/1975 | Guth | 241/46.015 |
| 5,775,049 | A | 7/1998 | Fricke | 52/720.1 |
| 5,820,348 | A | 10/1998 | Fricke | 416/248 |
| 5,855,353 | A | 1/1999 | Shaffer et al. | 248/638 |
| 5,924,261 | A | 7/1999 | Fricke | 52/720.1 |
| 5,924,635 | A | 7/1999 | Koshimizu et al. | 241/46.015 |
| 5,965,851 | A | 10/1999 | Herreman et al. | 181/200 |
| 6,007,006 | A | 12/1999 | Engel et al. | 241/46.014 |
| 6,659,223 | B2 * | 12/2003 | Allison et al. | 181/290 |
| 2002/0134615 | A1 | 9/2002 | Herreman et al. | 181/290 |

FOREIGN PATENT DOCUMENTS

| | | | |
|---|---|---|---|
| FR | 1143264 | 9/1957 | 9/1 |

OTHER PUBLICATIONS

International Search Report for corresponding PCT application No. PCT/IB02/04084.

Emerson Product Brochure for E-100, dated 1985, 3 pages.

Product Brochure of TOTO INAX ISE Sinkmaster PL, undated, received from URL: http://www.omino-jp.com/d_photo.htm, 1-page.

* cited by examiner

*Primary Examiner*—Mark Rosenbaum
(74) *Attorney, Agent, or Firm*—Harness, Dickey & Pierce P.L.C.

(57) ABSTRACT

A food waste disposer having devices to reduce noise is disclosed. The disposer has a food conveying section, a motor section, and a grinding section. To reduce the emitted noise that may result when food waste impacts the various components of the grinding section, in one embodiment, the present invention uses sound reduction layers attached to the external surfaces of the food conveying section, the motor section, and/or the central grinding section. The sound reduction layers may be made of materials that absorb, block, or dampen the emitted noise. The rotating shredder plate may have a first metallic layer, a second damping layer, and a third metallic layer. The stationary shredder ring may be made of a high-mass material or have a high-mass ring in connection with a stationary shredder ring. These devices may be combined with various disposer inlet baffles.

8 Claims, 6 Drawing Sheets

NOISE REDUCED FOOD WASTE DISPOSER

CROSS-REFERENCE TO RELATED APPLICATIONS

This Application claims the benefit of U.S. Provisional Application Ser. No. 60/327,426, filed Oct. 5, 2001.

FIELD OF THE INVENTION

The present invention relates generally to food waste disposers and, more particularly, to a food waste disposer having means to reduce noise emanating from the disposer during operation.

BACKGROUND OF THE INVENTION

A conventional food waste disposer typically includes an upper food conveying section, a lower motor section, and a central grinding section disposed between the food conveying section and the motor section. The food conveying section conveys the food waste to the central grinding section. The motor section includes an induction motor imparting rotational movement to a motor shaft. The grinding section includes a grinding mechanism having a circular rotating shredder plate, a pair of grinding lugs, and a stationary shredder ring. The plate is mounted to the motor shaft of the motor section. The shredder ring has a plurality of teeth.

In the operation of the food waste disposer, the food waste is passed through the food conveying section and to the grinding section. The food waste delivered to the grinding section is forced by grinding lugs on the rotating plate against teeth of the shredder ring. The edges of the teeth grind or communicate the food waste into particulate matter sufficiently small to pass from above the grinding plate to below the grinding plate via gaps between the teeth outside the periphery of the plate. Due to gravity, the particulate matter passes through the gaps between the teeth and drops to a section below the plate. Along with water injected into the disposer via the sink drain opening, the particulate matter is discharged through a discharge outlet into a waste tailpipe.

Conventional disposers generate external noise during operation. A primary source of noise during operation is the impact of food particles against the grinding mechanism (rotating shredder plate, grinding lugs, and stationary shredder ring). Additional noise is also created, in part, by the operation of the induction motor. To reduce noise, it has been known to place an insulating shell around the exterior housings of conventional disposers. Typical insulating shells contain an expanded polystyrene or open cell foam material as the insulating medium. While this technique reduces some of the noise emitted during operation of the disposer, further noise reduction is needed.

The present invention is directed to overcoming, or at least reducing noise emanated during the operation of food waste disposers.

SUMMARY OF THE INVENTION

To that end, the present invention provides means to reduce noise in a food waste disposer having an upper food conveying section, a motor section, and a central grinding section. The upper food conveying section includes a housing to receive food waste. The motor section includes another housing and a motor to impart rotational movement to a motor shaft. The central grinding section includes a stationary shredder ring, rotating shredder plate, and lugs.

The central grinding section is disposed between the food conveying section and the motor section. The food conveying section conveys food waste to the grinding section.

In one embodiment, the food waste disposer of the present invention includes at least one relatively thin non-porous sound reduction layer that is applied to portions of the exterior surface of the disposer. This non-porous material is composed of a heavy filler which when applied directly to a structure reflects noise back towards the source. The non-porous sound reduction layer also acts as a mass damper by reducing the vibrational motion of the disposer because of the relatively high specific gravity added by the non-porous material. The non-porous sound reduction layer also has an adhesive surface, which allows the material to be affixed to exterior surfaces of the disposer structure.

In another embodiment, the food waste disposer of the present invention includes multiple sound reduction layers that are applied to portions of the exterior surface of the disposer. In one embodiment, the first and third sound reduction layers are made of a flexible foam material. A second sound reduction layer is positioned between the first and third sound reduction layers and is preferably made of a non-porous barrier material as described in the preceding paragraph. An adhesive surface is used to affix the multiple layers to either the disposer structure or additional sound reduction layers. The first and third sound reduction layers serve as absorbers to convert the mechanical motion of the air particles in the sound waves into heat. The second (non-porous) sound reduction layer interrupts the path of the sound wave and reflects it back into the absorber thereby reducing the noise emanating from the operation of the food waste disposer.

In yet another embodiment, the food waste disposer of the present invention includes multiple sound reduction layers that are applied to portions of the exterior surface of the disposer. Here, however, a first sound reduction layer is made of a rubber-based mastic material, and a second sound reduction layer is made of an aluminum foil top film. The first sound reduction layer acts as a constrained layer damper because it is effectively constrained between two rigid surfaces—the disposer structure and the second sound reduction layer (i.e. aluminum top film). In this configuration, vibrational energy from the surface is dissipated as shear deformation of the mastic layer due to the constraining action of the aluminum foil (through the flexing and/or bending), thereby reducing the vibrational noise emanating from the disposer during operation.

In yet another embodiment, the food waste disposer of the present invention includes a granular sound reduction layer that is applied to portions of the exterior surface of the disposer. The granular sound reduction layer is preferably made of a lightweight material such as expanded perlite and is packed between an outer shell and the exterior surfaces of the disposer. This first sound reduction layer serves as a passive damping device. Perlite has a low sound speed that permits the energy in the sound wave to be attenuated through friction between the perlite particles and deformation of the particles at the contact points. In this embodiment, the perlite is in direct contact with the vibrating structure of the disposer thereby reducing the noise emanating from the operation of the disposer.

The present invention also relates to the composition of the rotating shredder plate located in the central grinding section. It has been found that a portion of the noise emitted during the operation of food waste disposers comes from the "ringing" noise and/or vibrational response caused by the impact of food particles against the rotating shredder plate, stationary shredder ring and disposer body. In this embodiment, the rotating shredder plate is made of multiple layers of stainless steel separated by a layer of viscoelastic damping material. The laminated construction increases the effective structural damping of the rotating shredder plate thereby resulting in less ringing and/or vibrational response caused by the impact of food particles.

Another embodiment includes providing, in combination with the above embodiments, a thick-walled, high-mass damping ring made out of a material such as a high mass plastic or cast iron. This damping ring is used with the shredder ring. High mass and increased structural damping of the high-mass material attenuates the noise caused by the vibrational response of impacting food particles against the shredder ring.

Yet another embodiment includes the addition of noise baffle devices as disclosed in U.S. patent application Ser. No. 10/066,893, filed Feb. 4, 2002 and entitled "A Baffle for a Food Waste Disposer to Reduce Noise and Associated Methods," which is owned by the assignee of the present application and incorporated herein by reference in its entirety. The baffle devices disclosed in that application may be combined with either one or more of the aforementioned sound reduction layers. The devices may also be combined with a rotating shredder plate made of a laminated metallic material and/or a stationary shredder ring made of a high-mass material.

Still, another embodiment includes the addition of a water baffle as disclosed in U.S. patent application Ser. No. 09/997,678, filed Nov. 29, 2001 and entitled "Food Waste Disposer Having a Mechanism and Method for Creating a Water Baffle to Reduce Noise," which is owned by the assignee of the present application and incorporated herein by reference in its entirety. The water baffle disclosed in that application may be combined with either one or more of the aforementioned sound reduction layers. The devices may also be combined with a rotating shredder plate made of a laminated metallic material and/or a stationary shredder ring made of a high-mass material.

Lastly, another embodiment includes any and all combinations of the foregoing embodiments. For example, multiple combinations of the disclosed insulating materials on various portions of the food waste disposer sections may be used in order to further reduce the noise emanated from the operation of the disposer.

The above summary of the present invention is not intended to represent each embodiment, or every aspect of the present invention. This is the purpose of the figures and detailed description, which follow.

BRIEF DESCRIPTION OF THE DRAWINGS

Other objects and advantages of the invention will become apparent upon reading the following detailed description and upon reference to the drawings.

Figure 1:
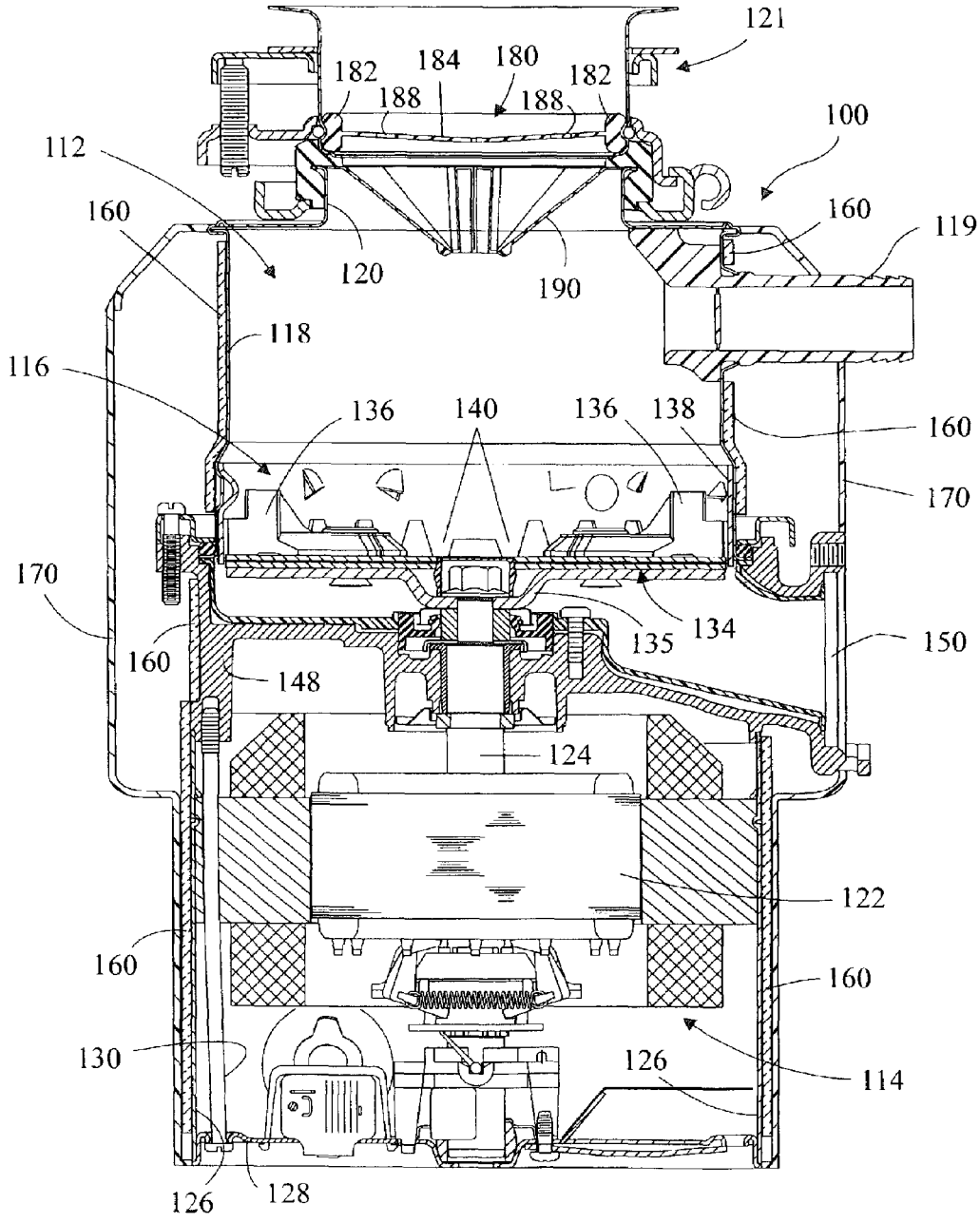
FIG. 1 is a cross-sectional view of a food waste disposer having a plurality of devices for reducing noise during operation according to the present invention. These devices include a laminated rotating plate housed in the disposer, a sound reduction layer attached to the disposer, and a noise baffle positioned in an inlet of the disposer.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DETAILED DESCRIPTION OF THE INVENTION

Illustrative embodiments will now be described with reference to the accompanying figures. Turning to the drawings, FIG. 1 depicts a food waste disposer 100 embodying the present invention. In one embodiment, the disposer 100 includes an upper food conveying section 112, a lower motor section 114, and a central grinding section 116.

The upper food conveying section 112 conveys the food waste to the central grinding section 116. The food conveying section 112 includes a housing 118. The housing 118 forms an inlet 120 at the upper end of the food waste disposer 100 for receiving food waste and water. The inlet 120 of the housing 118 is attached to a drain opening of a sink by a connecting apparatus 121. The housing 118 has another opening to receive a dishwasher inlet 119. The dishwasher inlet 119 is used to receive water from a dishwasher (not shown). The housing 118 may be made of metal or injection-molded plastic. Although FIG. 1 shows the housing 118 as two pieces, the housing 118 alternatively may be one unitary piece.

The central grinding section 116 is disposed between the upper food conveying section 112 and the motor section 114. The central grinding section 116 may include a grinding mechanism having a rotating plate 134, a pair of grinding lugs 136, and a stationary shredder ring 138. In the embodiment shown in FIG. 1, the grinding lugs 136 are fastened to the rotating plate 134 but are free to rotate relative to the rotating plate 134. Alternatively, the present invention could use a fixed lug assembly such as that disclosed in U.S. patent application Ser. No. 09/524,853, filed Mar. 14, 2000, which is owned by the assignee of the present application and incorporated herein by reference in its entirety.

The shredder ring 138 includes a plurality of spaced teeth 140. As shown in FIG. 1, in one embodiment, the shredder ring 138 may be made of stainless steel or other metallic material such as galvanized steel and inserted with interference fit into the outer housing which is typically made of plastic or stainless steel.

The rotating shredder plate 134 is attached to a lower support bracket 135, which is coupled to a motor shaft 124. Food waste particles impacting the rotating shredder plate can cause the plate to vibrate at its resonant frequencies creating noise. This type of noise, characterized as a ringing of the plate, can be reduced by increasing the mass of the plate or adding damping material to the plate. In one embodiment utilizing mass loading, the rotating shredder plate can be composed of a first metallic layer 156 with a second layer 152 of high mass material such as lead attached to the first layer either with an adhesive or by mechanical means. Alternatively, 152 can be a layer of a viscoelastic damping material such as rubber or other elastomer attached to the first layer either with an adhesive or by mechanical means. In a third embodiment, the second layer 152, can be a sprayed-on or troweled-on substance that bonds to the first layer 156 as it cures and acts as a damping material.

Figure 2A:
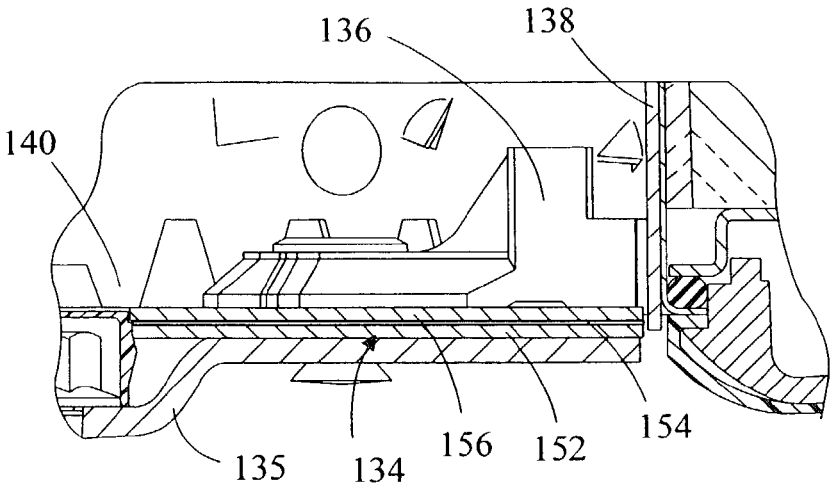
FIG. 2A is detailed view of the rotating plate of FIG. 1 having metallic layers separated by a viscoelastic damping material.

Although the extensional damping of the first metallic layer 156 with the second damping layer 152 discussed above can be effective, a preferred embodiment of the rotating shredder plate 134 is fabricated from layers of metal separated by a constrained layer of a damping material. In particular, as seen in the detailed view in FIG. 2A, the rotating shredder plate 134 has a first and third layer 152, 156 made of metal and an intermediate, second layer 154 made of a damping material, although it is understood that more than three layers can be used.

The first and third layers 152, 156 are preferably composed of stainless steel, and the second layer 154 is preferably composed of a viscoelastic material, which is known in the art. A suitable thickness for each layer depends on a number of variables, including the desired stiffness of the plate 134, the desired dampening level of the plate 134, the excitation frequency of the plate 134, and the effects of temperature on the plate 134, among other variables. The first and third layers 152 and 156 can both be approximately 0.030-inch thick, although they can have different thicknesses to achieve different benefits noted herein. The second layer 154 can be approximately 0.002 to 0.005-inch thick. With these thicknesses, the layers 152, 154, and 156 provide a suitable damping level, frequency range, temperature resistance, and overall thickness of the shredder plate 134.

The laminated construction increases the effective structural damping of the rotating shredder plate 134, thereby reducing the noise emanated during the operation of the disposer 100 caused by the vibrational response of impacting food particles. In other words, the use of laminated steel reduces the "ringing" noise seen by prior art stamped metal plates. Moreover, the use of a multi-layer laminate material for construction of the rotating shredder plate 134, in conjunction with the various sound reduction layers described below further reduces the noise emanated during the operation of the disposer 100.

In FIG. 1, the lower motor section 114 includes an induction motor 122 imparting rotational movement to a motor shaft 124. The motor 122 is enclosed within a motor housing 126. The motor housing 126 may include a formed metal band that wraps around the motor 122. The motor housing 126 may extend between a stamped metal lower end frame 128 and the upper end bell 148. In this embodiment, the lower motor section 114 is held into place by bolts 130 that extend from the stamped metal lower end frame 128 into or to the upper end bell 148.

In the operation of the food waste disposer 100, the food waste is passed through the food conveying section 112 and to the grinding section 116. The food waste delivered to the grinding section 116 is forced by the grinding lugs 136 on the rotating plate 134 against the teeth 140 of the shredder ring 138. As mentioned above, the use of a layered metal separated by a viscoelastic damping material for the rotating plate 134 reduces the noise caused by the vibrational response of impacting food particles on the rotating plate 134. The edges of the teeth 140 grind or communicate the food waste into particulate matter sufficiently small to pass from above the rotating plate 134 to below the rotating plate 134 via gaps between the teeth 140 outside the periphery of the plate 134. Due to gravity, the particulate matter passes through the gaps between the teeth 140 and drops to a section below the plate 134. Along with water injected into the disposer 100 via the sink drain opening, the particulate matter is discharged through a discharge outlet 150 into a waste tailpipe (not shown).

To further reduce noise emanating from the disposer 100, in one embodiment, a non-porous sound reduction layer 160 is applied to the exterior surfaces of the disposer 100. The non-porous sound reduction layer 160 is composed of heavy filler material that is preferably attached directly to the exterior surfaces of the disposer 100. One suitable material is SIKABARRIER 606, which may be obtained from Sika Corporation in Madison Heights, Mich. SIKABARRIER 606 has a 1.5-mm thick layer of loaded, rubber-based mastic with a 0.0030-inch polyethylene top film.

In this embodiment, the sound reduction layer 160 acts as a barrier and reflects noise back to the disposer. Because the non-porous sound reduction layer 160 is a relatively heavy material, it also acts as a mass damper by reducing vibrational motion during the operation of the disposer. The non-porous sound reduction layer 160 is preferably flexible and includes an adhesive surface that allows it to be fixedly applied to the various contours of the disposer 100 while eliminating air gaps between the disposer 100 and the non-porous sound reduction layer 160.

It is preferred that the non-porous sound reduction layer 160 be made of a material with a relatively high specific gravity, thus requiring less volume of material for a given mass. A material having a specific gravity of 2.0 to 2.5 has been found suitable for the disposer 100. This reduces the thickness of the sound reduction layer 160. Using a thin, flexible non-porous sound reduction layer 160 reduces the likelihood of outer component clearance problems. Moreover, the adhesive layer of the non-porous sound reduction layer 160 preferably has tenacious adhesion qualities that do not require surface preparation and allow the non-porous layer 160 to be applied to dirty or oily surfaces. Likewise, the non-porous sound reduction layer 160 preferably has material characteristics that are non-toxic and odorless as well as material characteristics that can withstand the heat generated during the operation of the disposer 100 without degradation or separation from the disposer 100.

The non-porous sound reduction layer 160 is directly applied to one or more of the exterior surfaces of the disposer 100. In one embodiment, as shown in FIG. 1, the non-porous sound reduction layer 160 is directly applied to a portion of the exterior surface of the housing 118 of the food conveying section 112. In this embodiment, the non-porous sound reduction layer 160 is also applied to the exterior surfaces of the upper end bell 148 and the motor housing 126. More than one non-porous sound reduction layer 160 can be applied to the sections of the disposer 100 as well as applied in a layer format in combination with other materials, some of which are described below. As shown in the embodiment of FIG. 1, an outer shell 170 preferably surrounds the disposer 100 primarily for aesthetic purposes.

To further reduce the noise from a food waste disposer, one may use baffle devices as disclosed in U.S. patent application Ser. No. 10/066,893, filed Feb. 4 2002 and entitled "A Baffle for a Food Waste Disposer to Reduce Noise and Associated Methods," which is owned by the assignee of the present application and incorporated herein by reference in its entirety. FIG. 1 shows the use of one of the embodiments in that application—a noise baffle 180 resting inside the opening of the connecting apparatus 121. In this embodiment, the noise baffle 180 has a cylindrical outer support wall 182 and a diaphragm portion 184. The noise baffle 180 is made of a softer material such as rubber. Suitable materials include Nitrile rubber and SANTOPRENE thermoplastic rubber. These materials are very durable and have good resistance to many acids, bases, and aqueous solutions.

Figure 2B:
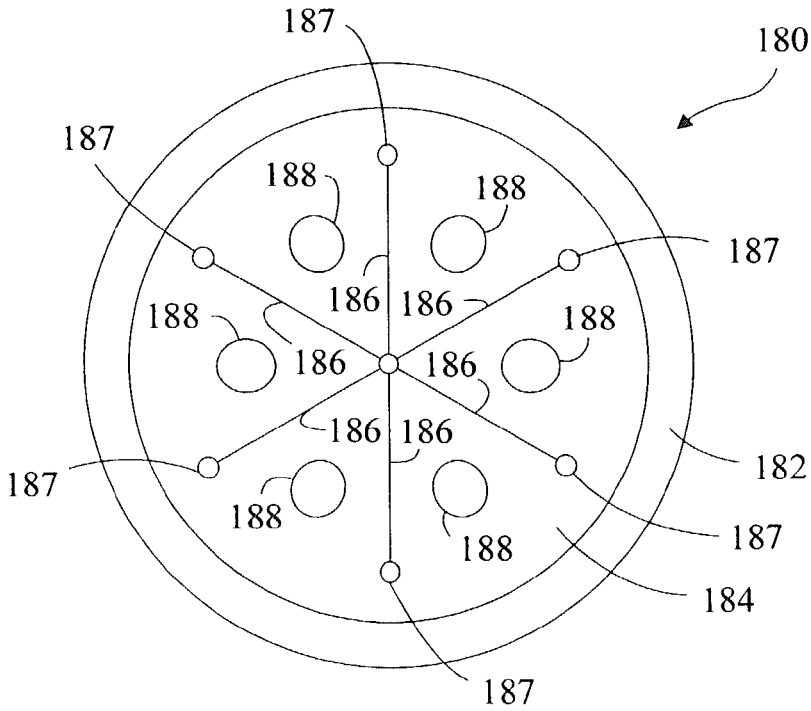
FIG. 2B is a top view of the noise baffle of FIG. 1.

A top view of the noise baffle 180 is shown in FIG. 2B. In this embodiment, the diaphragm portion 184 has a plurality of slots 186 and a plurality of drain holes 188. To prevent tearing, each end of the slots 186 has a small hole 187. The slots 186 allow larger food waste to pass from the drain opening to the disposer 100. The drain holes 188 allow a majority of the water and other liquids to pass from the drain opening to the disposer 100. The drain holes 188 are located between the slots 186. As liquids pass through the drain holes 188, the liquids fall on a chute portion of a mounting gasket (190). It is noted that the addition of the drain holes 188 allows a water dam to be created. As food waste enters the drain opening, the slots 186 will open and the food waste enters the disposer 100. When no food waste is present, the slots 186 close and the diaphragm portion 184 of the baffle 180 causes a water dam to reduce the noise emanating from the disposer 100.

Figure 3:
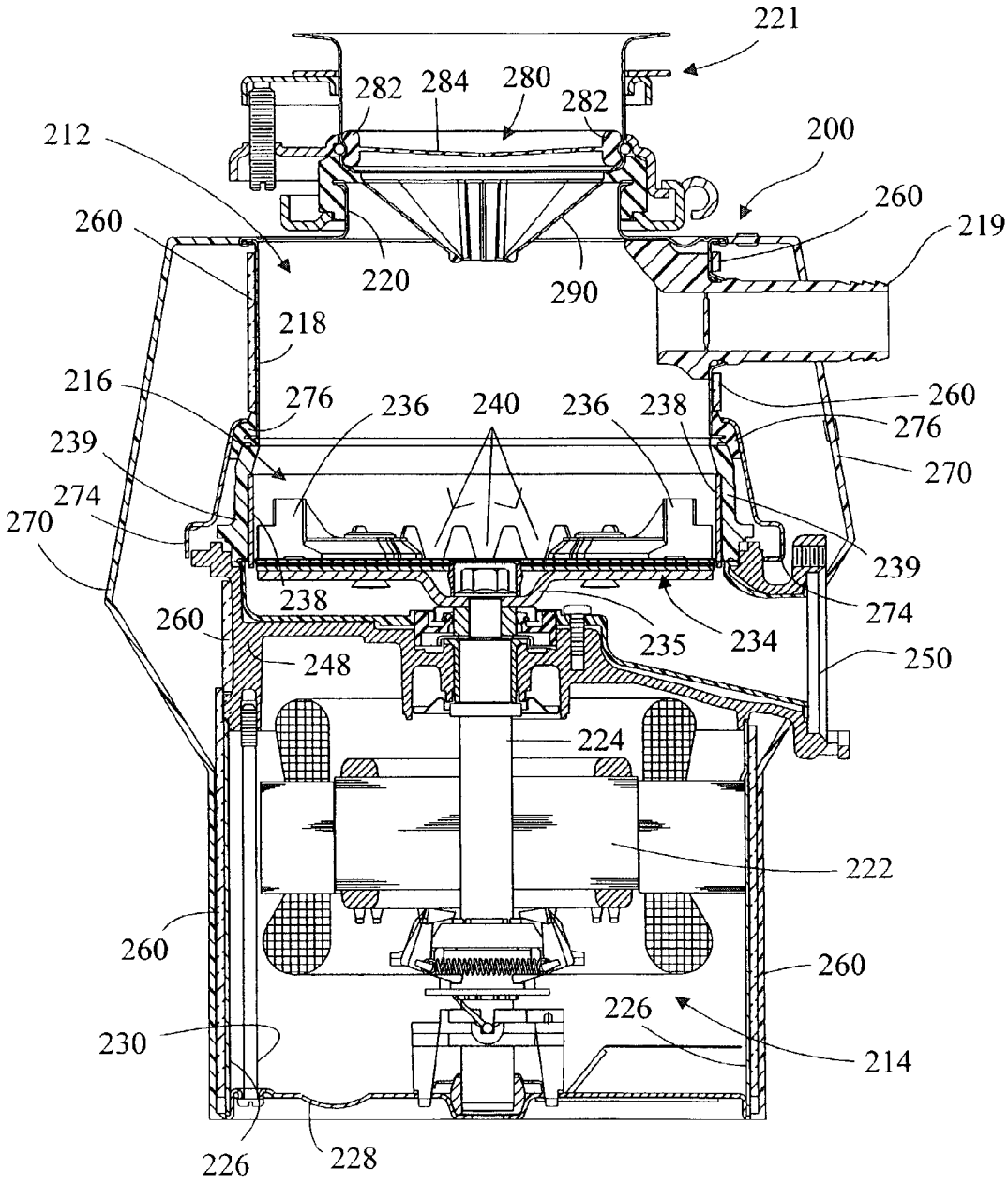
FIG. 3 is a cross-sectional view of a food waste disposer having an embodiment of a damping ring to reduce noise during operation.

Alternatively, in another embodiment as shown in FIG. 3, a high-mass damping ring 239 is added around the outside of the shredder ring 238. The high mass damping ring 239 is preferably made of a material with high mass and structural damping. The shredder ring 238 may be made of stainless steel or other metallic material such as galvanized steel and inserted with interference fit into the outer damping ring 239. The shredder ring 238 and damping ring 239 rests between a housing 218 of a food conveying section 212 and an upper end bell 248. One suitable material for the damping ring 239 is a high-mass molded plastic having a relatively thick wall. Instead of a high-mass plastic, a high-mass metallic material such as steel or cast iron may be used for the damping ring 239. Alternatively, the shredder ring 238 and high mass damping ring 239 can be made as one unitary body formed of a high-mass material such as Ni-hard, a wear and abrasion resistant white iron. Using a high-mass material in connection with the shredder ring 238 reduces the noise caused by food waste impacting the shredder ring 238. In this embodiment, as shown in FIG. 3, the shredder ring 238 is held into place by a metal clamp ring 274 and a seal 276. The shredder ring 238 has a plurality of teeth 240.

The upper food conveying section 212 of the disposer 200 conveys the food waste to the central grinding section 216. The housing 218 forms an inlet 220 at the upper end of the food waste disposer 200 for receiving food waste and water. The inlet 220 of the housing 218 is attached to a drain opening of a sink by a connecting apparatus 221. The housing 218 has another opening to receive a dishwasher inlet 219.

The stationary shredder ring 238 and outer high-mass damping ring 239 is included in the central grinding section 216. The central grinding section 216 also includes a rotating plate 234 and a pair of grinding lugs 236. In the embodiment shown in FIG. 3, the grinding lugs 236 are fastened to the rotating plate 234 but are free to rotate relative to the rotating plate 234. Alternatively, the present invention could use a fixed lug assembly such as that disclosed in patent application Ser. No. 09/524,853, filed Mar. 14, 2000, which is owned by the assignee of the present application and incorporated herein by reference in it entirety.

The lower motor section 214 includes an induction motor 222 imparting rotational movement to a motor shaft 224. The motor 222 is enclosed within a motor housing 226. The motor housing 226 may include a formed metal band that wraps around the motor 222. The motor housing 226 may extend between a stamped metal lower end frame 228 and the upper end bell 248. In this embodiment, the lower motor section 214 is held into place by bolts 230 that extend from the stamped metal lower end frame 228 into or to the upper end bell 248. The motor shaft 224 is attached to the rotating plate 234 by a support bracket 235.

In the operation of the food waste disposer 200, the food waste is passed through the food conveying section 212 and to the grinding section 216. The food waste delivered to the grinding section 216 is forced by the grinding lugs 236 on the rotating plate 234 against the teeth 240 of the shredder ring 238. The outer high-mass damping ring 239 reduces the noise caused by the vibrational response of food particles impacting the stationary shredder ring 238. As explained in more detail above with relation to FIGS. 1 and 2A, the rotating plate 234 here may also be made of a layered metal separated by a viscoelastic damping material. This further reduces the noise in the disposer caused by the vibrational response of impacting food particles on the rotating plate 234.

The edges of the teeth 240 grind or communicate the food waste into particulate matter sufficiently small to pass from above the rotating plate 234 to below the rotating plate 234 via gaps between the teeth 240 outside the periphery of the plate 234. Due to gravity, the particulate matter passes through the gaps between the teeth 240 and drops to a section below the plate 234. Along with water injected into the disposer 200 via the sink drain opening, the particulate matter is discharged through a discharge outlet 250 into a waste tailpipe (not shown).

To further reduce noise emanating from the disposer 200, in one embodiment, a non-porous sound reduction layer 260 is applied to the exterior surfaces of the disposer 200. Like the embodiment described in relation to FIG. 1, the non-porous sound reduction layer 260 is composed of heavy filler material that is preferably attached directly to the exterior surfaces of the disposer 200. The sound reduction layer 260 acts as a barrier and reflects noise back to the disposer. Because the non-porous sound reduction layer 260 is a relatively heavy material, it also acts as a mass damper by reducing vibration motion during the operation of the disposer. The non-porous sound reduction layer 260 is preferably flexible and includes an adhesive surface that allows it to be fixedly applied to the various contours of the disposer 200 while eliminating air gaps between the disposer 200 and the non-porous sound reduction layer 260.

The non-porous sound reduction layer 260 may be directly applied to one or more of the exterior surfaces of the disposer 200. In one embodiment, as shown in FIG. 3, the non-porous sound reduction layer 260 is directly applied to at least a portion of the exterior surfaces of the housing 218 of the food conveying section 212. In other embodiments, the non-porous sound reduction layer 260 is also applied to the exterior surfaces of the upper end bell 248 and the motor housing 226. More than one non-porous sound reduction layer 260 can be applied to the sections of the disposer 200 as well as applied in a layer format in combination with other materials, some of which are described below. As shown in the embodiment of FIG. 3, an outer shell 270 preferably surrounds the disposer 200.

To further reduce the noise from the food waste disposer 200, one may use baffle devices as disclosed in U.S. patent application Ser. No. 10/066,893, filed Feb. 4, 2002 and entitled "A Baffle for a Food Waste Disposer to Reduce Noise and Associated Methods," which is owned by the assignee of the present application and incorporated herein by reference in its entirety. FIG. 3 shows the use of one of the embodiments in that application—a noise baffle 280 resting inside the opening of the connecting apparatus 221. In this embodiment, the noise baffle 280 has a cylindrical outer support wall 282 and a diaphragm portion 284. The noise baffle 280 is made of a softer material such as rubber. Suitable materials include Nitrile rubber and SANTOPRENE thermoplastic rubber. These materials are very durable and have good resistance to many acids, bases, and aqueous solutions. Further description of the noise baffle is found above in relation to FIGS. 1 and 2B as well as the pending U.S. Patent application mentioned herein.

Figure 4:
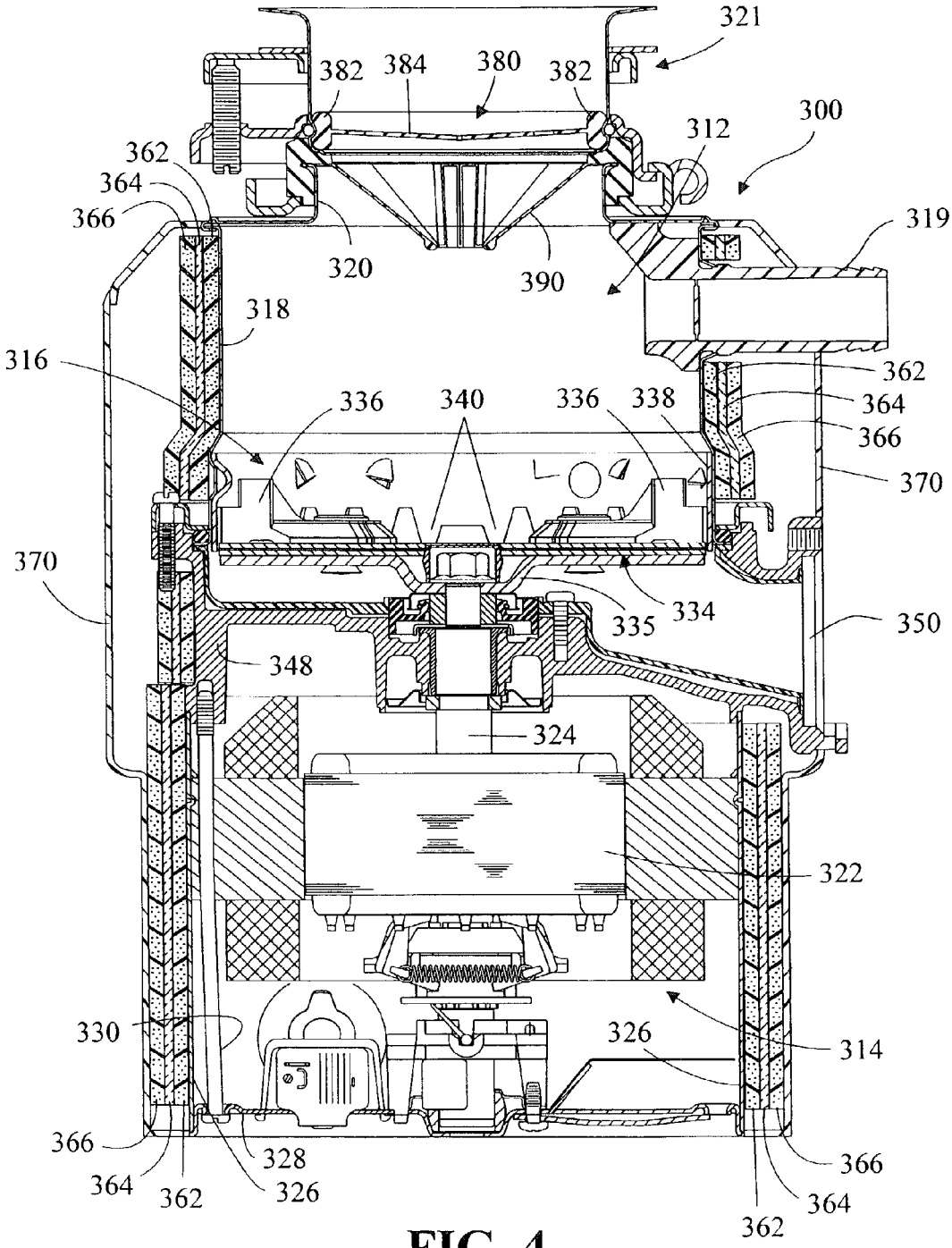
FIG. 4 is a cross-sectional view of a food waste disposer having an embodiment of multiple sound reduction layers to reduce noise during operation.

In another embodiment of the present invention, FIG. 4 illustrates a disposer 300 having an upper food conveying section 312, a lower motor section 314, a central grinding section 316, and multiple sound reduction layers 362, 364, 366. The application of the multiple sound reduction layers 362, 364, 366 to the disposer 300 has been found to further reduce the noise emanating from the disposer during operation.

In this embodiment, the first and third sound reduction layers 362, 366 are made of a porous foam material. The second sound reduction layer 364 is preferably made of a non-porous heavy filler material such as the material described in relation to FIG. 1. The second sound reduction layer 364 is positioned between the first and third sound reduction layers 362, 366. The layers 362, 364, 366 are preferably molded or formed together. The first sound reduction layer 364 should also have an adhesive surface to attach the multiple layers 362, 364, 366 to the exterior surfaces of the disposer 300.

The first and third sound reduction layers 362, 364 act as absorbers by converting the mechanical motion of the air particles in the sound waves emitted during the operation of the disposer 300 into heat. Acting as a barrier, the second layer 364 interrupts and reflects the path of the sound wave in order to reduce the noise emanated during the operation of the disposer 300. The second sound reduction layer can be composed of a substantially non-porous barrier material, such as a rubber, a mass loaded polyvinyl chloride, or a loaded mastic. Suitable materials for the multiple sound reduction layers 362, 364, 366 may be obtained from Blachford Inc. in West Chicago, Ill, as product number Blachford BAX3-11C. In that product, the first and third sound reduction layers are composed of about 0.25-inch thick foam material and a second sound reduction layer of about 1.0 to 1.8 lbs./ft.sup.2 barrier material. The product also includes about a 3-mm thick pressure sensitive adhesive surface. A fourth sound reduction material also composed of a substantially non-porous barrier material may be attached to the third sound reduction layer.

The upper food conveying section 312 of the disposer 300 conveys the food waste to the central grinding section 316. A housing 318 forms an inlet 320 at the upper end of the food waste disposer 300 for receiving food waste and water. The inlet 320 of the housing 318 is attached to a drain opening of a sink by a connecting apparatus 321. The housing 318 has another opening to receive a dishwasher inlet 319.

A stationary shredder ring 338 is included in the central grinding section 316. The central grinding section 316 also includes a rotating plate 334 and a pair of grinding lugs 336. The lower motor section 314 includes an induction motor 322 imparting rotational movement to a motor shaft 324. The motor 322 is enclosed within a motor housing 326. The motor housing 326 may include a formed metal band that wraps around the motor 322. The motor housing 326 may extend between a stamped metal lower end frame 328 and an upper end bell 348. In this embodiment, the lower motor section 314 is held into place by bolts 330 that extend from the stamped metal lower end frame 328 into or to the upper end bell 348. The motor shaft 324 is attached to the rotating plate 334 by a support bracket 335.

In the operation of the food waste disposer 300, the food waste is passed through the food conveying section 312 and to the grinding section 316. The food waste delivered to the grinding section 316 is forced by the grinding lugs 336 on the rotating plate 334 against the teeth 340 of the shredder ring 338. As explained in more detail above with relation to FIGS. 1 and 2A, the rotating plate 334 here may also be made of a layered metal separated by a viscoelastic damping material. This further reduces the noise in the disposer caused by the vibrational response of impacting food particles on the rotating plate 334.

The edges of the teeth 340 grind or communicate the food waste into particulate matter sufficiently small to pass from above the rotating plate 334 to below the rotating plate 334 via gaps between the teeth 340 outside the periphery of the plate 334. Due to gravity, the particulate matter passes through the gaps between the teeth 340 and drops to a section below the plate 334. Along with water injected into the disposer 300 via the sink drain opening, the particulate matter is discharged through a discharge outlet 350 into a waste tailpipe (not shown).

To further reduce the noise from the food waste disposer 300, one may use baffle devices as disclosed in U.S. patent application Ser. No. 10/066,893, filed Feb. 4, 2002 and entitled "A Baffle for a Food Waste Disposer to Reduce Noise and Associated Methods," which is owned by the assignee of the present application and incorporated herein by reference in its entirety. FIG. 4 shows the use of one of the embodiments in that application—a noise baffle 380 resting inside the opening of the connecting apparatus 321. In this embodiment, the noise baffle 380 has a cylindrical outer support wall 382 and a diaphragm portion 384. The noise baffle 380 is made of a softer material such as rubber. Suitable materials include Nitrile rubber and SANTOPRENE thermoplastic rubber. These materials are very durable and have good resistance to many acids, bases, and aqueous solutions. Further description of the noise baffle is found above in relation to FIGS. 1 and 2B as well as the pending U.S. Patent application mentioned herein.

Figure 5:
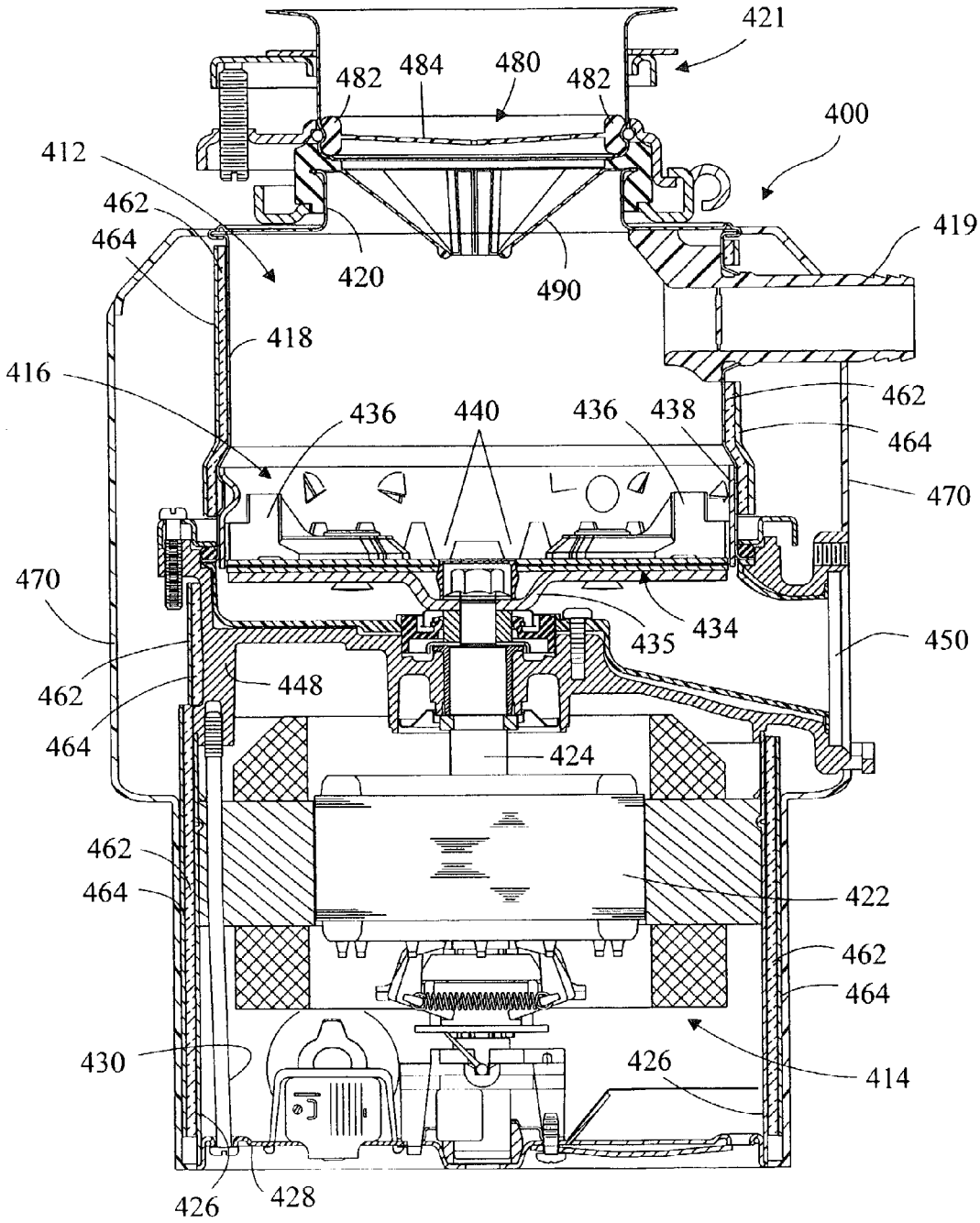
FIG. 5 is a cross-sectional view of a food waste disposer having another embodiment of multiple sound reduction layers to reduce noise during operation.

In a further embodiment of the present invention, as illustrated in FIG. 5, a disposer 400 of the present invention includes an upper food conveying section 412, a lower motor section 414, a central grinding section 416, and multiple sound reduction layers 462 and 464. In this embodiment, the first sound reduction layer 462 is made of a viscoelastic rubber-based mastic material. The second sound reduction layer 464 is made of an outer metal foil top film. The first sound reduction layer 462 acts as a constrained layer damper because it is effectively constrained between two rigid surfaces—the disposer 400 and the second sound reduction layer 464. The first sound reduction layer 462 preferably includes adhesive surfaces to fixedly attach the first sound reduction layer 462 to the disposer 400 and to fixedly attach the first sound reduction layer 462 to the second sound reduction layer 464.

The second sound reduction layer 464 acts as a constraining layer on the rubber mastic. Vibration energy emitted from the disposer 400 surface is dissipated in the first sound reduction layer 462 as shear deformation as a result of the constraining actions of the second sound reduction layer 464 extensional damper, thereby reducing the vibrational noise emanating from the disposer 400 during operation. Suitable materials for the multiple sound reduction layers 462, 464 may be obtained from Sika Corporation in Madison Heights, Mich., as SIKADAMP 630. In that product, the first sound reduction layer is about 1-mm thick rubber-based mastic material. The second sound reduction layer is about 0.0040-inch thick aluminum foil top film.

The multiple sound reduction layers 462 and 464 are preferably directly applied to at least a portion of the exterior surfaces of the disposer 400. It is preferred that the first sound reduction layer 462 be a relatively lightweight, flexible, non-toxic, odorless material with tenacious adhesion which allows the material to be applied to dirty or oily surfaces without surface preparation. Further, the metal foil top film (sound reduction layer 464) can vary in thickness and can be a non-metal material, such as a MYLAR, a polyester, or a polyethylene material.

The upper food conveying section 412 of the disposer 400 conveys the food waste to the central grinding section 416. A housing 418 forms an inlet 420 at the upper end of the food waste disposer 400 for receiving food waste and water. The inlet 420 of the housing 418 is attached to a drain opening of a sink by a connecting apparatus 421. The housing 418 has another opening to receive a dishwasher inlet 419.

A stationary shredder ring 438 is included in the central grinding section 416. The central grinding section 416 also includes a rotating plate 434 and a pair of grinding lugs 436. The lower motor section 414 includes an induction motor 422 imparting rotational movement to a motor shaft 424. The motor 422 is enclosed within a motor housing 426. The motor housing 426 may include a formed metal band that wraps around the motor 422. The motor housing 426 may extend between a stamped metal lower end frame 428 and an upper end bell 448. In this embodiment, the lower motor section 414 is held into place by bolts 430 that extend from the stamped metal lower end frame 428 into or to the upper end bell 448. The motor shaft 424 is attached to the rotating plate 434 by a support bracket 435.

In the operation of the food waste disposer 400, the food waste is passed through the food conveying section 412 and to the grinding section 416. The food waste delivered to the grinding section 416 is forced by the grinding lugs 436 on the rotating plate 434 against the teeth 440 of the shredder ring 438. As explained in more detail above with relation to FIGS. 1 and 2A, the rotating plate 434 here may also be made of a layered metal separated by a viscoelastic damping material. This further reduces the noise in the disposer caused by the vibrational response of impacting food particles on the rotating plate 434.

The edges of the teeth 440 grind or communicate the food waste into particulate matter sufficiently small to pass from above the rotating plate 434 to below the rotating plate 434 via gaps between the teeth 440 outside the periphery of the plate 434. Due to gravity, the particulate matter passes through the gaps between the teeth 440 and drops to a section below the plate 434. Along with water injected into the disposer 400 via the sink drain opening, the particulate matter is discharged through a discharge outlet 450 into a waste tailpipe (not shown).

To further reduce the noise from the food waste disposer 400, one may use baffle devices as disclosed in U.S. patent application Ser. No. 10/066,893, filed Feb. 4, 2002 and entitled "A Baffle for a Food Waste Disposer to Reduce Noise and Associated Methods," which is owned by the assignee of the present application and incorporated herein by reference in its entirety. FIG. 5 shows the use of one of the embodiments in that application—a noise baffle 480 resting inside the opening of the connecting apparatus 421. In this embodiment, the noise baffle 480 has a cylindrical outer support wall 482 and a diaphragm portion 484. The noise baffle 480 is made of a softer material such as rubber. Suitable materials include Nitrile rubber and SANTOPRENE thermoplastic rubber. These materials are very durable and have good resistance to many acids, bases, and aqueous solutions. Further description of the noise baffle is found above in relation to FIGS. 1 and 2B as well as the pending U.S. Patent application mentioned herein.

Figure 6:
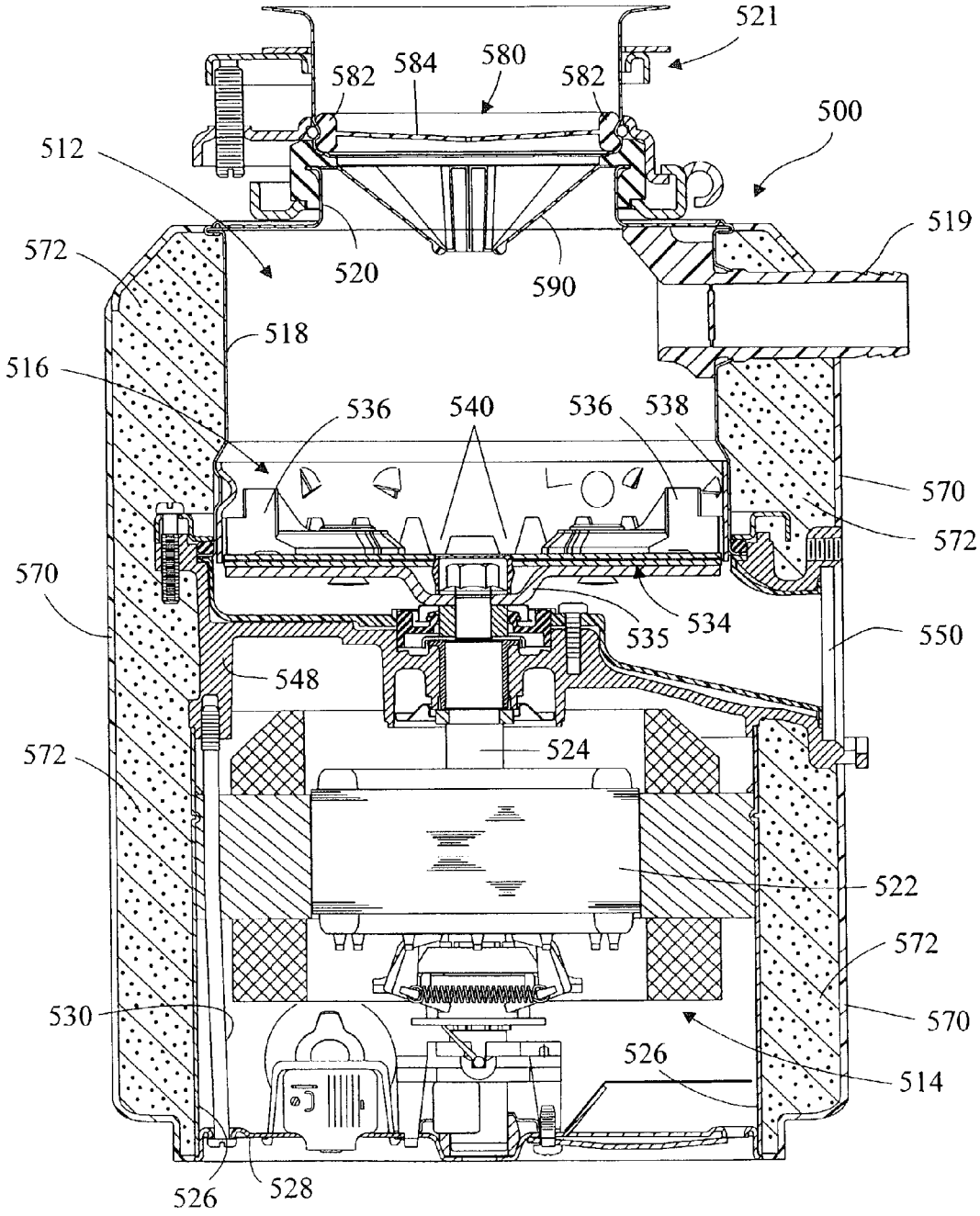
FIG. 6 is a cross-sectional view of a food waste disposer having a granular sound reduction layer to reduce noise during operation.

In yet another embodiment of the present invention, FIG. 6 illustrates a disposer 500 having an upper food conveying section 512, a lower motor section 514, a central grinding section 516, an outer shell 570, and a granular sound reduction layer 572. In this embodiment, the sound reduction layer 572 is a relatively lightweight granular material, such as expanded perlite. Perlite is a generic term for naturally occurring silicous rock. The sound reduction layer 572 (made of a granular material) is disposed around the central grinding section 516 of the disposer 500. The outer shell 570 preferably surrounds at least portions of the central grinding section 516 although the outer shell 570 may also surround portions of the upper food conveying section 512 and/or the lower motor section 514 as shown in FIG. 6. The granular sound reduction layer 572 fills the cavity created between the outer shell 570 and the exterior surfaces of the sections 512, 514, 516.

The use of this granular sound reduction layer 572 as a noise insulation material utilizes passive damping that places a low-density granular material in direct contact with the vibrating structure. Such damping is further described in U.S. Pat. Nos. 5,775,049, 5,820,348, and 5,924,261. The use of a granular sound reduction layer 572 has been found to provide better sound reduction than prior art disposers using a rigid, expanded polystyrene material.

The granular sound reduction layer 572 used in the present invention preferably has a low sound speed that permits the energy in the sound wave emitted during the operation of the disposer 500 to be attenuated through friction between the granular particulates of the sound reduction layer 572, thereby reducing the noise emanated from the disposer 500 during operation.

The preferred material of the granular sound reduction layer 572 is expanded perlite, but other materials could include glass microspheres and low-density polyethylene spheres. The use of perlite is preferred because it is lightweight. Expanded perlite may be manufactured to weigh as little as 2.0 to 2.5 lbs./ft$^3$. The use of such lightweight materials results in a reduction in vibrational energy and associated noise similar to that achieved with sand or lead shot but without the massive weight of those materials, thereby making the use of materials such as expanded perlite a more efficient application.

The upper food conveying section 512 of the disposer 500 conveys the food waste to the central grinding section 516.

A housing 518 forms an inlet 520 at the upper end of the food waste disposer 500 for receiving food waste and water. The inlet 520 of the housing 518 is attached to a drain opening of a sink by a connecting apparatus 521. The housing 518 has another opening to receive a dishwasher inlet 519.

A stationary shredder ring 538 is included in the central grinding section 516. The central grinding section 516 also includes a rotating plate 534 and a pair of grinding lugs 536. The lower motor section 514 includes an induction motor 522 imparting rotational movement to a motor shaft 524. The motor 522 is enclosed within a motor housing 526. The motor housing 526 may include a formed metal band that wraps around the motor 522. The motor housing 526 may extend between a stamped metal lower end frame 528 and an upper end bell 548. In this embodiment, the lower motor section 514 is held into place by bolts 530 that extend from the stamped metal lower end frame 528 into or to the upper end bell 548. The motor shaft 524 is attached to the rotating plate 534 by a support bracket 535.

In the operation of the food waste disposer 500, the food waste is passed through the food conveying section 512 and to the grinding section 516. The food waste delivered to the grinding section 516 is forced by the grinding lugs 536 on the rotating plate 534 against the teeth 540 of the shredder ring 538. As explained in more detail above with relation to FIGS. 1 and 2A, the rotating plate 534 here may also be made of a layered metal separated by a viscoelastic damping material. This further reduces the noise in the disposer caused by the vibrational response of impacting food particles on the rotating plate 534.

The edges of the teeth 540 grind or communicate the food waste into particulate matter sufficiently small to pass from above the rotating plate 534 to below the rotating plate 534 via gaps between the teeth 540 outside the periphery of the plate 534. Due to gravity, the particulate matter passes through the gaps between the teeth 540 and drops to a section below the plate 534. Along with water injected into the disposer 500 via the sink drain opening, the particulate matter is discharged through a discharge outlet 550 into a waste tailpipe (not shown).

To further reduce the noise from the food waste disposer 500, one may use baffle devices as disclosed in U.S. patent application Ser. No. 10/066,893, filed Feb. 4, 2002 and entitled "A Baffle for a Food Waste Disposer to Reduce Noise and Associated Methods," which are owned by the assignee of the present application and incorporated herein by reference in their entirety. FIG. 6 shows the use of one of the embodiments in that application—a noise baffle 580 resting inside the opening of the connecting apparatus 521. In this embodiment, the noise baffle 580 has a cylindrical outer support wall 582 and a diaphragm portion 584. The noise baffle 580 is made of a softer material such as rubber. Suitable materials include Nitrile rubber and SANTOPRENE thermoplastic rubber. These materials are very durable and have good resistance to many acids, bases, and aqueous solutions. Further description of the noise baffle is found above in relation to FIGS. 1 and 2B as well as the pending U.S. Patent application mentioned herein.

Still, another embodiment includes the addition of a water baffle to the above described disposers as disclosed in U.S. patent application Ser. No. 09/997,678, filed Nov. 29, 2001 and entitled "Food Waste Disposer Having a Mechanism and Method for Creating a Water Baffle to Reduce Noise," which is owned by the assignee of the present application and incorporated herein by reference in its entirety. The water baffle disclosed in that application may be combined with either one or more of the aforementioned embodiments. The devices may also be combined with a rotating shredder plate made of a laminated metallic material and/or a stationary shredder ring in connection with a high-mass ring.

A disposer of the present invention may also use different combinations described above. Using combinations of the sound reduction means described herein has been found to further significantly reduce the noise emanating from the disposer during operation. For example, one could use the disposer illustrated in FIG. 3 with multiple sound reduction layers. Attached to the exterior surface of the upper housing 218 and the upper end bell 248 could include: a first sound reduction layer made of non-porous heavy filler material; a second sound reduction layer made of a porous foam material, a third sound reduction layer made of non-porous heavy filler material; a fourth sound reduction layer made of a porous foam material; and a fifth sound reduction layer made of a non-porous heavy filler material. Attached to the exterior surface of the lower motor housing 226 could include: a first sound reduction layer made of a porous foam material, a second sound reduction layer made of non-porous heavy filler material; a third sound reduction layer made of a porous foam material; and a fourth sound reduction layer made of a non-porous heavy filler material.

Another example of suitable combination would include the disposer as shown in FIG. 3 with multiple sound reduction layers. Attached to the exterior surface of the upper housing 218 and the upper end bell 248 could include: first and second sound reduction layers made of non-porous heavy filler material; a third sound reduction layer made of a porous foam material; a fourth sound reduction layer made of a non-porous heavy filler material; and a fifth sound reduction layer made of a porous foam material.

What has been described is a food waste disposer having various devices to reduce noise emanating from the disposer during operation. The devices may be applied either alone or in combination to various sections of the food waste disposer. Moreover, the various devices described herein may be combined to achieve even greater sound reduction. Accordingly, the food waste disposer having the devices described herein operates quieter than conventional disposers.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A food waste disposer, comprising:

a housing having an exterior surface, the housing including an a upper portion defining an inlet and a central portion defining a generally cylindrical side wall;

first, second and third sound reduction layers, the first layer attached to the exterior surface of the side wall of the central portion of the housing, the second layer attached to the first layer and the third layer attached to the second layer;

the first layer a porous sound absorption layer, the second layer a non-porous sound barrier layer and the third layer a porous sound absorption layer; and the first, second and third layers substantially surrounding the side wall of the housing.

2. The food waste disposer of claim 1, wherein the first and third layers are composed of a foam material.

3. The food waste disposer of claim 1, wherein an adhesive attaches the first layer to the exterior surface of the housing.

4. The food waste disposer of claim 1, wherein the second layer is approximately 1.0 to 1.8 lbs. per square foot.

5. The food waste disposer of claim 1, wherein the second layer is selected from the group consisting of a rubber, a mass loaded polyvinyl chloride, and a loaded mastic.

6. The food waste disposer of claim 1 further including a fourth sound reduction layer attached to the third layer and substantially surrounding the side wall of the housing, the fourth layer a non-porous sound barrier layer.

7. The food waste disposer of claim 6, wherein the fourth layer is approximately 1.0 to 1.8 lbs. per square foot.

8. The food waste disposer of claim 6, wherein the fourth layer is selected from the group consisting of a rubber, a mass loaded polyvinyl chloride, and a loaded mastic.

* * * * *